US006012583A

United States Patent [19]

Ramirez

[11] Patent Number: 6,012,583

[45] Date of Patent: Jan. 11, 2000

[54] EGG CARTON

[75] Inventor: Richard L. Ramirez, Lawrenceville, Ga.

[73] Assignee: Tekni-Plex, Inc., Somerville, N.J.

[21] Appl. No.: 09/153,526

[22] Filed: Sep. 15, 1998

[51] Int. Cl.[7] ..... B65D 81/02

[52] U.S. Cl. ..... 206/521.1; 206/521.4; 206/521.7; 206/521.9; 206/508

[58] Field of Search ..... 206/521, 521.1, 206/521.15, 521.2, 521.3, 521.4, 521.5, 521.6, 521.7, 521.8, 521.9; 220/507, 508

[56] References Cited

U.S. PATENT DOCUMENTS

| | | | |
|---|---|---|---|
| D. 164,302 | 8/1951 | Harper . | |
| D. 208,275 | 8/1967 | Pearl et al. . | |
| D. 224,518 | 8/1972 | Pearl et al. . | |
| D. 263,680 | 4/1982 | Schroder . | |
| D. 281,955 | 12/1985 | Moller . | |
| D. 291,533 | 8/1987 | Mangla . | |
| D. 306,138 | 2/1990 | Congleton et al. . | |
| D. 308,822 | 6/1990 | Congleton . | |
| 2,600,130 | 6/1952 | Schilling . | |
| 2,885,136 | 5/1959 | Grant . | |
| 3,034,693 | 5/1962 | Cox . | |
| 3,120,319 | 2/1964 | Buddrus . | |
| 3,185,370 | 5/1965 | Reifers et al. . | |
| 3,224,618 | 12/1965 | Vigue . | |
| 3,310,217 | 3/1967 | Trimble . | |
| 3,372,854 | 3/1968 | Marcus . | |
| 3,396,895 | 8/1968 | Pearl et al. . | |
| 3,398,875 | 8/1968 | Snow et al. . | |
| 3,486,678 | 12/1969 | Donaldson . | |
| 3,563,446 | 2/1971 | Lake et al. . | |
| 3,567,107 | 3/1971 | Artz | 206/521.1 |
| 3,572,578 | 3/1971 | Rohdin . | |
| 3,643,855 | 2/1972 | Donaldson | 206/521.1 |
| 3,672,693 | 6/1972 | Weir . | |
| 3,767,103 | 10/1973 | Reifers . | |
| 3,817,441 | 6/1974 | Jackson . | |
| 3,877,599 | 4/1975 | Morris . | |
| 3,917,152 | 11/1975 | Burkett . | |
| 4,059,219 | 11/1977 | Reifers et al. . | |
| 4,088,259 | 5/1978 | Sutton | 206/521.1 |
| 4,090,658 | 5/1978 | Fukuda . | |
| 4,298,156 | 11/1981 | Reifers et al. | 206/521.1 |
| 4,355,731 | 10/1982 | Carroll et al. . | |
| 4,361,263 | 11/1982 | Thomas | 206/521.1 |
| 4,382,536 | 5/1983 | Congleton . | |
| 4,394,214 | 7/1983 | Bixler et al. . | |
| 4,419,068 | 12/1983 | Congleton . | |
| 4,465,225 | 8/1984 | Bixler et al. | 206/521.1 |
| 4,625,907 | 12/1986 | Mangla . | |
| 4,688,714 | 8/1987 | Padovani . | |
| 4,742,953 | 5/1988 | Jacobs et al. . | |
| 4,795,080 | 1/1989 | McIntyre . | |
| 5,282,534 | 2/1994 | Lapp . | |
| 5,494,164 | 2/1996 | Ramirez . | |

FOREIGN PATENT DOCUMENTS

| | | |
|---|---|---|
| 727439 | 2/1966 | Canada . |

OTHER PUBLICATIONS

Mobil Chemical Advertisement, "The 18 Egg Foam Carton Designed for High Performance", Feb. 10, 1986.

"Egg–Handling Gets New Rules by U.S. to Cut Salmonella", *Wall Street Journal*, p. B20, col. 5, May 19, 1998.

*Primary Examiner*—Paul T. Sewell
*Assistant Examiner*—J. Mohandesi
*Attorney, Agent, or Firm*—Stroock & Stroock & Lavan LLP

[57] ABSTRACT

An egg carton is provided having various nesting/denesting features, a ventilation system, reinforced portions, and capability of accommodating and protecting various sized eggs. The nesting/denesting features include thickened corners on the lid, an indented post and a stacking ledge on the tray, each feature reducing the amount of surface contact between nesting components and facilitating denesting. The ventilation system includes channels formed in the cells of the tray and a vent which enables effective natural and artificial cooling of packaged eggs. The reinforced portions include embossments being formed on the bases of each of the cells, along with compacted raised portions. Finally, the cells are provided with high flexible walls for protecting the eggs and deflectable cushions shaped and located to securely hold eggs which are smaller than the natural size of the cells.

30 Claims, 5 Drawing Sheets

EGG CARTON

BACKGROUND OF THE INVENTION

1. Field of the Invention

The present invention relates to packaging formed from a thermoplastic polystyrene material and, more particularly, egg cartons formed from a thermoplastic polystyrene material.

2. Description of the Prior Art

Many factors are taken into consideration in the design of egg cartons. Egg protection, aesthetic appearance, print surface area, strength, weight, nestability/denestability, adaptability to accommodate various size eggs, and consistent manufacturing are factors which may be considered to varying degrees in the design of an egg carton. As can be readily appreciated, certain design factors are diametrical, e.g., strength of the carton is typically sacrificed upon reduction in weight and/or thickness, and vice versa.

The importance of many of the design factors can be better appreciated by understanding the "life" of an egg carton. Polystyrene egg cartons are formed and trimmed from a single sheet of polystyrene material to integrally define a lid and a tray. The formed egg cartons are transported, typically by conveyer belt, to a printing machine and imprinted with an egg distributor's trade style, government mandated nutritional information, and retail information, such as UPC labels. The egg cartons are then nested one within another and packaged in bags or pallets for shipping to egg distributors. The volume of the nested egg cartons within each package unit is a direct function of the nestability of the egg cartons. At the egg distributors, through automation, the egg cartons are denested and stamped with necessary information, e.g., expiration dates. Eggs are afterwards packaged into the egg cartons, and the packaged egg cartons are then placed into storage containers ready for shipping to retailers. Various storage containers are used in the industry including cases (each typically holds thirty dozen egg cartons), metal grid baskets (each typically holds fifteen dozen egg cartons), milk crates (each typically holds between twelve dozen and fifteen dozen egg cartons), and racks formed to be wheeled or slid into grocery store display cases (with each rack typically holding between 240–360 dozen egg cartons). Due to the relatively high quantity of egg cartons per storage container, the stored packaged egg cartons can be subjected to relatively high compressive loading. For example, in some of the aforesaid storage containers, the egg cartons are stacked seven high. Taking into consideration that one dozen "jumbo" sized eggs weigh between 30–32 ounces, and assuming seven egg cartons are in a stacked arrangement, with each egg carton containing one dozen "jumbo" sized eggs, the bottom-most egg carton will be subjected to a loading of between 180–192 ounces (11.25–12 pounds) of compressive force. The compressive loading is amplified where the bottom-most egg carton is placed on an irregular surface, such as the bottom of a metal grid basket, wherein greater compressive pressures are applied to the bottom portions of the egg carton contacting the irregular surface (i.e., the compressive loading applied to the bottom-most egg carton is in turn applied to the storage container through a relatively small amount of area, as defined by the portions of the egg carton contacting the storage container, which translates the applied compressive loading to higher pressures being developed in the contacting portions of the egg carton). Once shipped, the egg cartons are displayed at the retail outlet in the respective storage container, or alternatively, stocked on shelving of a display rack or case. Again, significant compressive pressures may be generated upon the packaged egg cartons at display. Finally, the packaged egg cartons are purchased by consumers and taken home for consumption of the eggs.

A commercially successful egg carton is disclosed in U.S. Pat. No. 5,494,164, entitled "EGG CARTON", which issued on Feb. 27, 1996 to the inventor herein. U.S. Pat. No. 5,494,164 discloses an egg carton having cells which are configured to expand toward the interior of the egg carton upon receiving an egg, and having common intersections, each defined by four adjacent cells, which are progressively lowered going outwardly from the center of the tray towards the respective ends of the tray. Although the egg carton of U.S. Pat. No. 5,494,164 has been commercially successful, improvements in egg protection, nesting/denesting and carton strength are always desired.

Another consideration in egg carton design, which is growing in importance, is the temperature control of eggs packaged in the egg carton. Proper refrigeration of eggs combats the spread of Salmonella Enteritidis. As reported in the *Wall Street Journal*, May 19, 1998, p. B20, col. 5, 4.5 million eggs are annually found to be contaminated with Salmonella Enteriditis, and, since 1985, at least 77 people have died and 26,000 have become ill from the pathogen. The United States Agriculture Department and the United States Food and Drug Administration have proposed requiring shippers to transport eggs and retailers to display eggs at temperatures of 45° F. or below.

It is an object of the subject invention to provide an egg carton with excellent denesting capabilities at reduced stack pitch.

It is an also an object of the subject invention to provide an egg carton having reinforced and stable egg cell bases.

It is yet another object of the subject invention to provide an egg carton having venting features to allow for packaged eggs to properly cool naturally or be cooled artificially.

It is a further object of the subject invention to provide an egg carton formed to accommodate and protect various sized eggs.

SUMMARY OF THE INVENTION

The aforementioned objects are met by an egg carton having various nesting/denesting features, a ventilation system, reinforced portions, and capability of accommodating and protecting various sized eggs.

Although more complete and compact nesting is desired to increase the number of unpackaged egg cartons per unit volume during shipping and storage, egg cartons may be excessively nested, wherein portions of the nested egg cartons are too tightly wedged into one another and/or evacuation occurs in some entrapped areas. Excessive nesting results in poor denesting, with not only overall difficulty in separating nested egg cartons, but also uneven separation. As is readily apparent, excessive nesting can lead to process interruptions in denesting and carton breakage. The subject invention includes features which reduce the possibility of excessive nesting. First, the lid of the egg carton of the subject invention is formed with thickened corners. As such, upon nesting, the lids of the egg cartons rest upon the corners, with the respective side walls thereof being spaced apart. Second, larger egg cartons (those for holding respectively one dozen eggs and one-and-a-half dozen eggs) typically have posts formed in the respective lids for additional support of the lid and stacking strength. In accordance with the subject invention, the inner surface of the post is indented to define an inwardly extending indentation. In nesting the egg cartons, the posts are stacked on their respective ends, with voids being defined between the posts by the indentations. Third, cell dividers along the longitudinal sides of the tray are contoured to come into engagement upon nesting. As a result, the cells of nested egg cartons cannot be excessively nested. Finally, a stacking ledge is continuously formed along each of the longitudinal edges of the tray which is shaped to support the tray upon nesting. The degree of nesting of the trays is limited by the stacking ledges. In sum, the four features described above limit the amount of surface contact between nested egg cartons and, thus, prevent excessive nesting. By limiting the amount of surface contact, evacuation between components and excessive wedging of components are avoided.

As an additional feature of the egg carton of the subject invention, an egg ventilation system is provided. The system includes channels located in each of the cells, which extend substantially the full length of the respective cell, and atmospheric vents formed in the lid or the tray or cooperatively defined by the lid and the tray. The channels are formed with sufficient length to extend below the widest portion of a packaged, egg (the widest portion of an egg being known as the "girth"), with the egg being disposed "air space down" (an egg has a narrow "point" end and a wider "air space" end). Additionally, the ventilation system can include end cell dividers which are low cut to allow for air communication with lowermost portions of eggs packaged at the ends of an egg carton. With the ventilation system, eggs can be naturally air cooled through convection within a packaged egg carton to avoid condensation being formed therein.

Additionally, artificial cooling applied to the packaged egg carton can better cool the eggs through the ventilation system than the prior art. It should be noted that, although the subject invention provides for cooling of packaged eggs, the egg carton still has acceptable insulative properties.

The egg carton of the subject invention further includes features directed to strengthening the bases of the egg cells. Specifically, with respect to each of the egg cells, embossments are formed to extend from the base of the egg cell to a point on the adjacent side wall located above the base. The embossments act as struts to transfer loading force applied on the base to the side wall, thus ridgifying the base. Also, the exterior surfaces of the bases of the egg cells are formed with raised, centrally-located button portions which are surrounded by annular-shaped resting surfaces. The annular-shaped resting surfaces provide strength about the bases of the egg cells and stable supports for the egg cells. The inclusion of the button portions respectively creates a cantilever effect which transfers weight applied to the center of the base to the surrounding resting surface. As an additional advantage, the button portions reduce the amount of exterior surface area of the bases which come into contact with an underlying surface. Because of the reduction in exterior surface area, the bases have less overall contact with the underlying surface and less friction being acted thereupon.

Additionally, the egg carton of the subject invention is formed to accommodate various sized eggs. U.S. Pat. No. 5,494,164, discussed above, discloses an egg carton formed to accommodate not only "extra large" eggs (weighing 27–29 ounces per dozen) but also "jumbo" eggs and "super jumbo" eggs (weighing 33–35 ounces per dozen). However, the egg carton of U.S. Pat. No. 5,494,164 has no provision to accommodate smaller eggs ("large", "medium", "small") with the eggs being securely held within the cells of the egg carton. With respect to the subject invention, it is preferred that the cells be nominally formed to accommodate "extra large" eggs in a natural state. The channels described above provide flexibility in the egg cells and allow for accommodation of "jumbo" eggs. To accommodate "large" eggs, inwardly extending cushions are provided in each of the cells which are spaced apart and each formed to engage in point contact a "large" egg. With the cushions, a "large" egg can be immovably held in each respective cell. Additionally, the cushions are deflectable to allow for unhindered accommodation of "extra large" and "jumbo" eggs.

These and other features of the invention will be better understood through a study of the following detailed description and accompanying drawings.

DETAILED DESCRIPTION OF THE PREFERRED EMBODIMENTS

Referring generally to the Figures, an egg carton 100 is shown which is formed to accommodate eighteen eggs. The egg carton 100 is illustrative of the inventive features disclosed herein.

The teachings of this disclosure may be equally applied to forming different sized egg cartons, including eight-egg and one-dozen-egg egg cartons.

Figure 1:
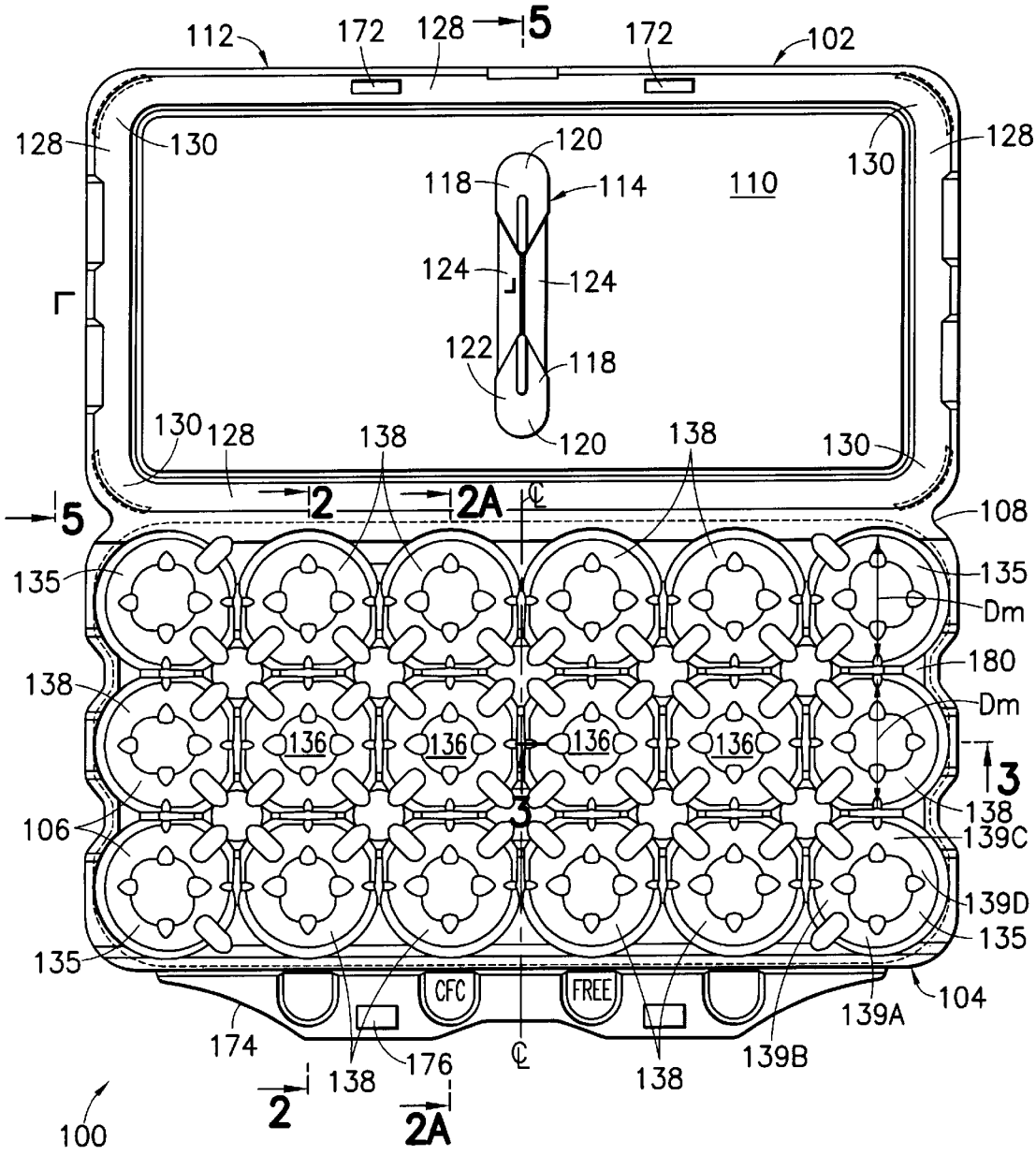
FIG. 1 is a top view of an eighteen-egg egg carton formed in accordance with the subject invention.
Figure 6:
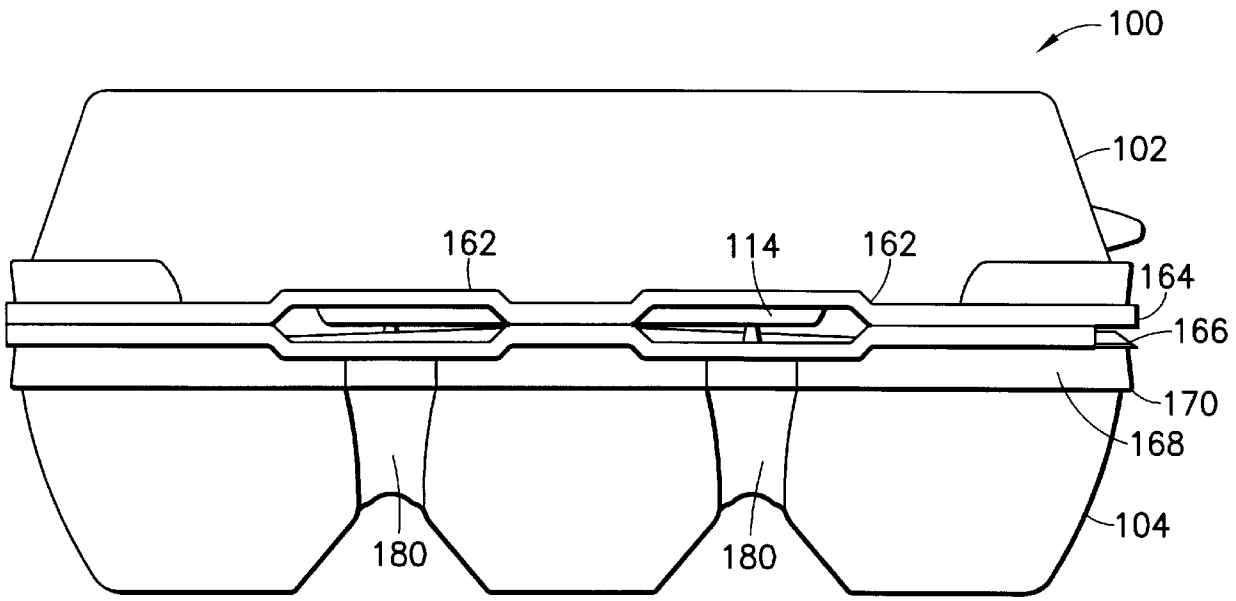
FIG. 6 is a side elevational view of the egg carton in a closed position.

The egg carton 100 is formed with a lid 102 and a tray 104 having eighteen cells 106, each formed to accommodate a single egg. The lid 102 and the tray 104 are connected by a hinge 108 which allows for relative rotation therebetween with the lid 102 capable of rotating from an open position, as shown in FIG. 1, to a closed position, as shown in FIG. 6. The entire egg carton 100 is unitarily molded from a polystyrene material, wherein the lid 102, the tray 104 and the hinge 108 are all formed from a single sheet of polystyrene material.

Figure 5:
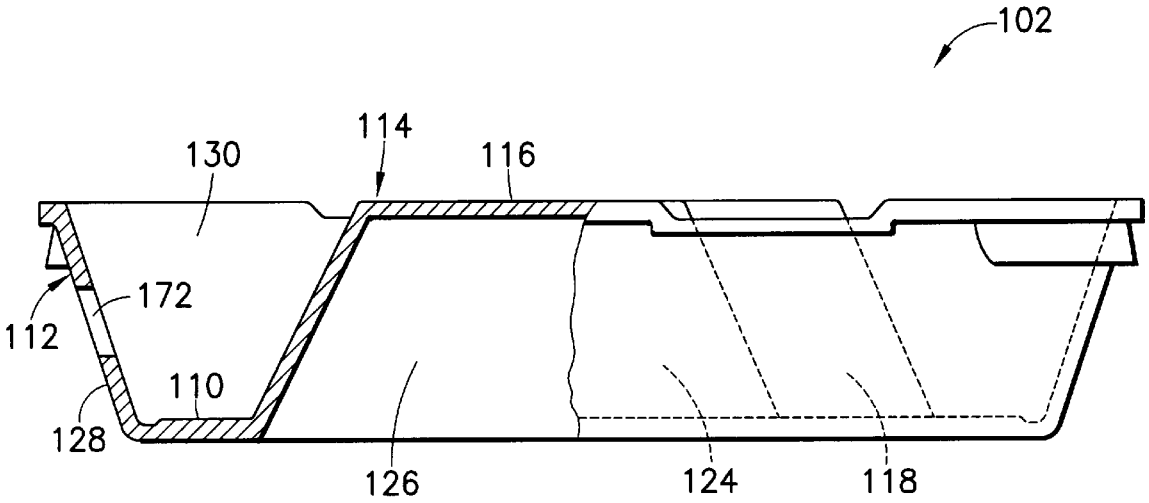
FIG. 5 is a partial cross-sectional view taken along line 5—5 of FIG. 1.

The lid 102 is more clearly shown in FIG. 5 and is formed to include a planar top portion 110 and an upstanding side wall 112 extending from the perimeter of the top portion 110. A post 114 extends centrally from the top portion 110. The post 114 has a trapezoidal profile with a supporting surface 116 being spaced from the top portion 110. The supporting surface 116 is formed to be coplanar with the top edge of the side wall 112 so that, with the lid 102 being in a closed position, the post 114 will engage the tray 104 as shown in FIG. 6. With the post 114 engaging the tray 104, extra rigidity and support is provided to the center of the lid 102 for stacking support. The post 114 is necessary in larger egg carton sizes, but not with smaller egg cartons, such as an eight-egg egg carton. The post 114 is also formed with longitudinal side walls 118 and tapered, rounded end corners 120. The longitudinal side walls 118 are formed with outer surfaces 122 having indentations 124 formed therein, and smooth inner surfaces 126. Preferably, the indentations extend from the top portion 110 and towards the supporting surface 116.

Figure 8:
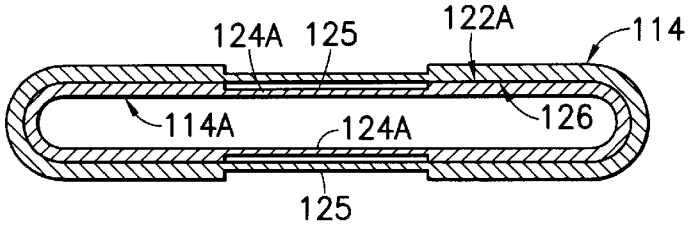
FIG. 8 is a partial cross-sectional view of two nested posts formed in accordance with the subject invention.

Referring to FIG. 8, two of the posts 114, 114A are shown in a nested arrangement. As can be seen, the inner surface 126 of the post 114 is in engagement with the outer surface 122A of the post 114A. Voids 125 are defined respectively between the indentations 124A and the inner surface 126. The voids 125 reduce contact between the posts 114 and 114A, thereby reducing the likelihood of both a vacuum being formed between the posts 114 and 114A and excessive wedging occurring therebetween.

Figure 4:
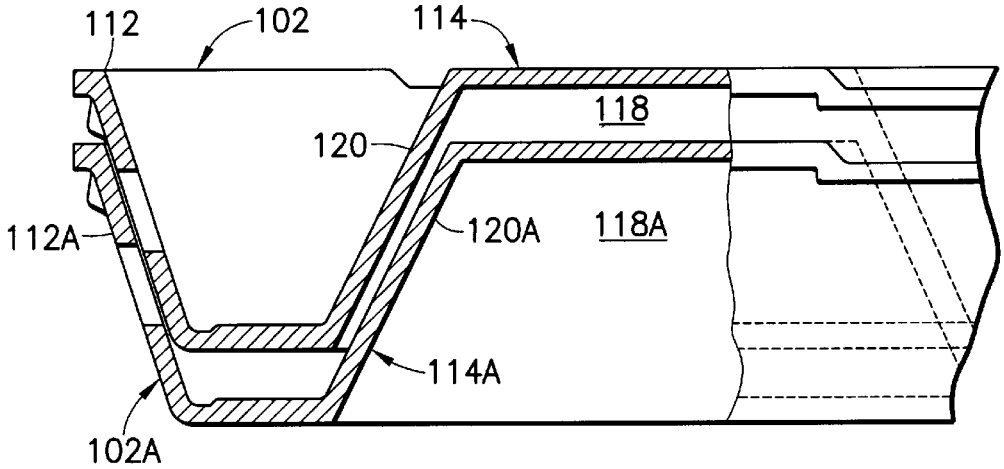
FIG. 4 is a partial cross-sectional view of two nested lids formed in accordance with the subject invention.
Figure 9:
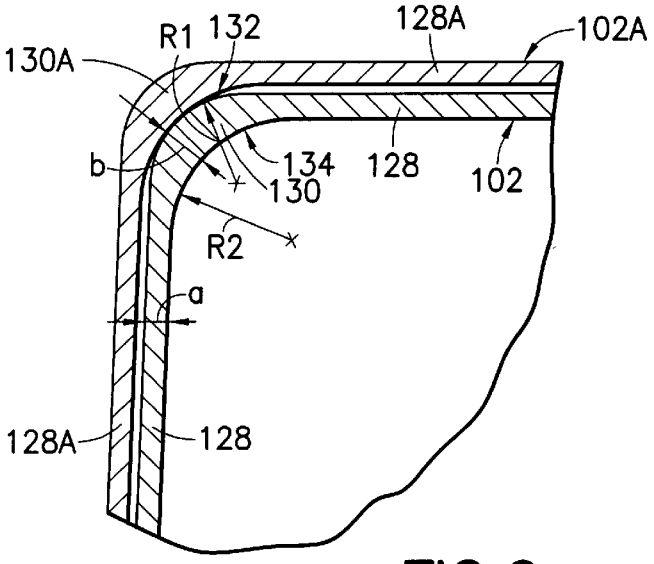
FIG. 9 is a partial cross-sectional view of two nested lids formed in accordance with the subject invention.

With reference to FIG. 1, the side wall 112 generally defines a rectangular shape with four straight portions 128 being joined by four corners 130. FIG. 9 is a representative cross-section of the corners 130 which also shows segments of the straight portions 128. The dimension "a" represents the thickness of the straight portions 128, whereas dimension "b" represents the thickness of the corners 130. In accordance with the subject invention, the dimension "a" is formed less than the dimension "b". Through this formation, the lid 102 can be nested with a second lid 102A being identically formed to the lid 102. The lid 102A is shown in the FIGS. with like parts being designated by the same reference numerals as described above followed by the character "A". In a nested arrangement, the lid 102 is supported by the corners 130 which rest on the corners 130A, and the straight portions 128 are spaced from the straight portions 128A. Additionally, as shown in FIG. 4, the tapered end corners 120 of the post 114 are spaced from the tapered end corners 120A of the lid 102A. It is preferred that the longitudinal side walls 118 and 118A be in engagement. The engagement of the longitudinal side walls 118 and 118A provides rigidity to the centers of the lids 102, 102A in a nested arrangement. As a result of forming the corners 130 as described above, surface contact is minimized between the lids 102 and 102A and excessive nesting is avoided.

Referring again to FIG. 9, in a preferred embodiment, the dimension "a" equals 0.080 inches and the dimension "b" equals 0.100 inches. It should be noted that the dimension "b" is located centrally of the corner 130. To produce the lid 102 with an aesthetically-pleasing appearance, the corner 130 is formed to gradually taper from the dimension "b" to the dimension "a" of the straight portions 128. Preferably, outside surface 132 of the corner 130 defines a radius R1 which is less than radius R2 defined by inside surface 134.

The cells 106 of the tray 104 are each generally cupshaped and formed as either a corner cell 135, an interior cell 136 or an exterior cell 138. The egg carton 100 has a matrix of the cells 106 with three columns and six rows. Consequently, the egg carton 100 has four corner cells 135, four interior cells 136, and ten exterior cells 138. In forming an eight-egg egg carton, a matrix of two columns and four rows is provided with four corner cells 135 and four exterior cells 138. In forming a one-dozen-egg egg carton, a matrix of two columns and six rows is provided with four corner cells 135 and eight exterior cells 138. As is apparent, eight-egg egg cartons and one-dozen-egg egg cartons do not include any of the interior cells 136, only the corner cells 135 and the exterior cells 138.

Figure 2:
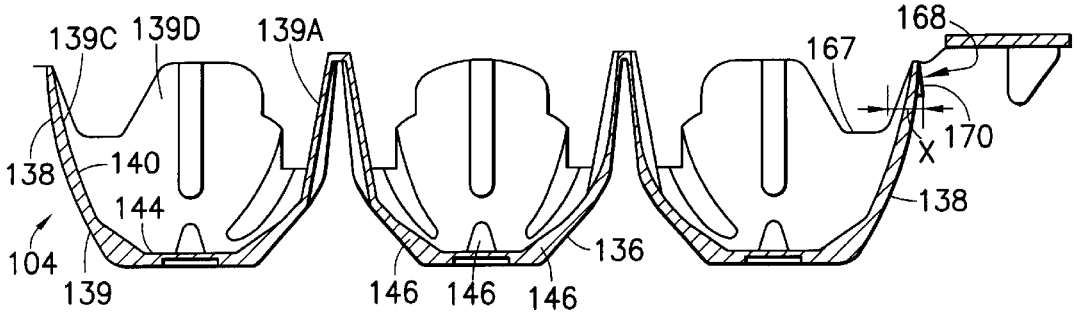
FIG. 2 is a cross-sectional view of three cells taken along line 2—2 of FIG. 1.
Figure 3:
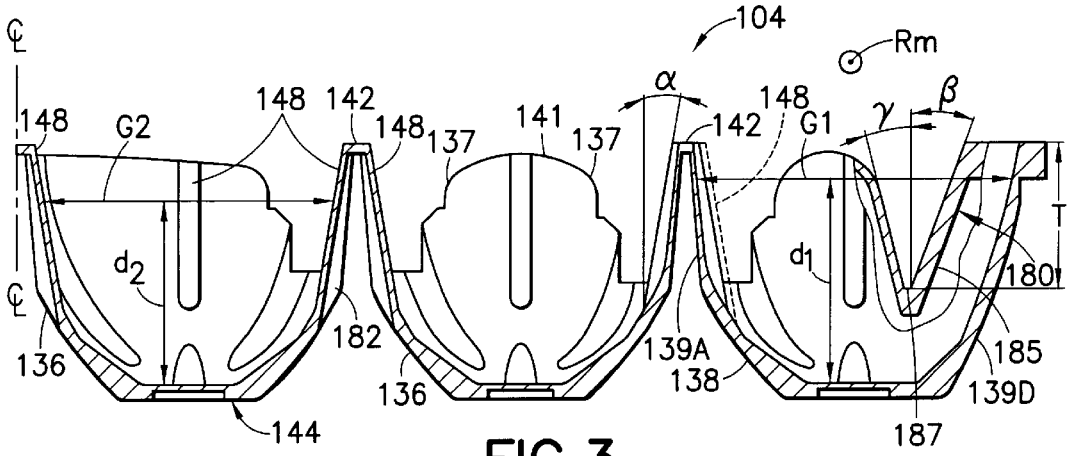
FIG. 3 is a cross-sectional view of three cells taken along line 3—3 of FIG. 1.

Referring to FIGS. 1, 2 and 3, each of the cells 106 is formed with a tubular side wall 139 having four joined wall portions 139A–D to define an inner receiving surface 140 contoured to receive the ovoid shape of an egg. Each of the wall portions 139A–D is arcuately formed in two coordinate directions to define the necessary ovoid contour. The side wall 139 extends upwardly to define an open top and, where there is an adjoining cell 106, joins with the side wall 139 of the adjoining cell 106, with the two side walls 139 cooperatively defining a cell tab 142. The cell tab 142 has generally at least one rounded shoulder 137, preferably formed about a radius of 0.1875", which blends into a raised upper edge 141. The upper edge 141 is flexible to respond to pressure applied by packaged eggs and provides protection therefor.

Figure 2A:
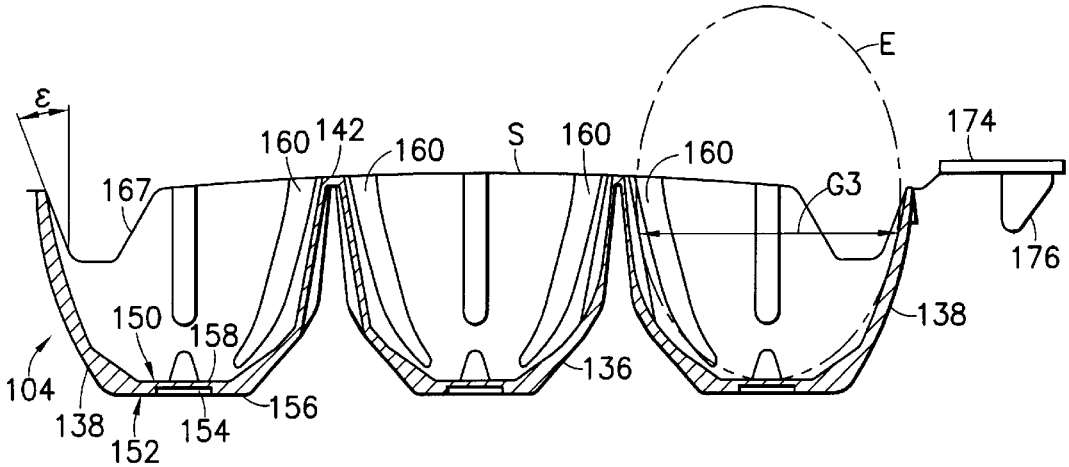
FIG. 2A is a cross-sectional view of three cells taken along line 2A—2A of FIG. 1.

FIG. 2 is a cross-sectional view taken across a row, whereas FIG. 3 is a cross-sectional view taken across a column. With reference to FIG. 1, a center line "CL" is located in the middle of the tray 104 in the row direction. The three rows formed to the left of the center line "CL" are preferably mirror images of the three rows formed to the right of the center line "CL". The four outermost rows, i.e., the rows spaced from the center line "CL", have cross-sections generally formed as shown in FIG. 2 in solid lines. The two innermost rows, i.e., the rows closest to the center line "CL", have cross-sections generally formed as shown in FIG. 2A. The columns are symmetrically formed about the center line "CL" with the cells 106 to the right of the center line "CL" being mirror images of the cells to the left of the center line "CL". FIG. 3 depicts the three cells 106 to the right of the center line "CL". The cell formation from column to column is the same.

The innermost cells 106 have cell tabs 142 which are coplanar with the top of the tray 104. As such, the cell tabs 142 define a surface "s" for supporting the post 114, as described above. The exterior cells 138 formed along the longitudinal sides of the tray 104 are joined by side cell dividers 167, whereas exterior cells and corner cells along the ends of the tray 104 are joined by end cell dividers 180.

The side wall 139 in each of the cells 106 extends downwardly to a planar base 144. Embossments 146 extend angularly between the base 144 and the receiving surface 140. The embossments 146 are preferably formed with solid cross-sections. Also, preferably, four embossments 146 are formed in each of the cells 106 and are disposed to be equally spaced about the base 144. The embossments 146 act as struts and provide additional rigidity to the base 144.

Cushions 148 may also be provided to be integrally formed with and extend inwardly from the side wall 139. It should be noted that the receiving surface 140 is formed to accommodate an "extra large" egg in a natural state with the egg being disposed "point down". An "extra large" egg has a nominal girth of 1.79' which is located at approximately 1.32' from its "point". The egg receiving surface 140 is formed to define a diameter "G1" which is equal to the nominal girth of an "extra large" egg and is located a distance "d1" from the base 144. The distance "d1" is preferably 1.32'. The receiving surface 140 is also pliable, as described below, to accommodate larger eggs, such as "jumbo". The cushions 148 are formed to extend from the receiving surface 140 to provide point supports for smaller eggs (eggs smaller than "extra large") to prevent movement of the eggs within the cells 106. With the cushions 148, the cells 106 can accommodate eggs which are smaller in size than what the receiving surface 140 is formed to accommodate. A "large" egg has nominally a girth of 1.74' which is located approximately 1.25' from its point. As shown in FIG. 3, the cushions 148 preferably define an inner diameter "G2" which equals the nominal girth of a "large" egg. Also, the diameter "G2" is defined at a distance "d2" from the base 144 wherein the distance "d2" is preferably 1.25'. The cushions 148 are deflectable to allow for unhindered accommodation of "extra large" and "jumbo" eggs. In particular, the cushions 148 are pleat-shaped to allow for outward expansion with the cushions 148 becoming coextensive or substantially coextensive with the egg receiving surface 140.

Also, the cushions 148 are formed to extend angularly from the tops of the cell tabs 142 downwardly at an angle $\alpha$. The angle $\alpha$ is preferably 10°. The cushion is also preferably formed to extend sufficiently to allow for nesting with other cushions. As shown in FIG. 3, the cushions 148 each extend to define an open mouth portion 182 which can slide onto and nest with another of the cushions 148. It should be noted that FIGS. 2, 2A and 3 depict both the cross-sections of the cushions 148 and side views of the cushions 148 for illustrative purposes. The cushions 148 are preferably centered on the respective wall portions 139A–D.

The base 144 is formed with a flat interior surface 150 and an exterior surface 152 having a raised button portion 154 being defined therein. The raised button portion 154 is formed by densifying the polystyrene material of the base 144. The exterior surface 152 also defines an annular shaped resting surface 156 which encompasses the raised button portion 154. The provision of the raised button portion 154 provides effective load transfer from the base 144 to the receiving surface and additional rigidity. In particular, the raised button portion 154 defines a compacted area 158 in the base 144 which becomes more highly stressed than surrounding portions of the base 144. With the loading being concentrated at the compacted area 158, the loading is uniformly transferred through the base 144 to the receiving surface 140 through a cantilever effect. It should be noted that the inclusion of the raised button portion 154 reduces the overall surface area of the exterior surface 152 without reducing lateral stability of the base 144. As such, frictional forces acting on the base 144 are reduced with the egg carton 106 having sufficient stability to resist tipping. It should also be noted that the overall foot print of the bases 144 is not altered and the relatively wide shape of the foot print provides excellent stability for the egg carton.

Channels 160 are formed to extend into the receiving surface 140 of each of the cells 106. With respect to the interior cells 136, four of the channels 160 are provided, while with respect to the corner cells 135 and the exterior cells 138, two of the channels 160 are provided. The channels 160 advantageously provide a degree of pliability to the cells 106 which allows for expansion thereof to accommodate larger size eggs. Both U.S. Pat. No. 4,382,536 entitled "FOAM EGG CARTON", which issued to Congleton on May 10, 1983, and U.S. Pat. No. 5,494,164, described above, disclose the use of pleats to allow for egg cell expansion. U.S. Pat. Nos. 4,382,536 and 5,494,164 are incorporated by reference herein.

The channels 160 are formed to extend further into the cells 106 than the pleats of the two aforementioned prior art patents. As shown in FIG. 2A, the channels 160 extend into proximity to the bases 144, therefore having greater lengths than the pleats of the prior art. In this manner, the channels 160 are ensured to extend below the girth "G3" of an egg "E" disposed in the cell 106. Since packaging orientation of the egg "E" is typically "point down" (eggs can be packed "point down" or "air space down" with 15%–40% of eggs being packed "air space down"), the channels 160 ensure that air circulation can be achieved about the lowermost portion of the packaged egg "E" even where the girth "G3" acts to seal off the lowermost portion of the cell 106. The egg carton 100 is also formed with vents 162 for communicating the air entrapped by the egg carton 100 in a closed position with the open atmosphere. In one embodiment, the vents 162 can be side vents, as shown in FIG. 6, wherein the lid 102 has a flange 164 and the tray 104 has a flange 166, with the flanges 164, 166 collectively defining the vents 162. Alternatively, although not shown, the vents 162 can be formed as openings in the lid 102 and/or the tray 104. By providing a combination of the channels 160 and the vents 162, air flow is created along substantial arc portions of eggs packaged in the egg carton 100. In contrast to the prior art, bottom portions of packaged eggs, which may be the larger portion of the egg, are advantageously exposed to air flow. Accordingly, packaged eggs can be better naturally air cooled than in the prior art and also are better subjected to environmental conditioning, such as refrigeration.

To improve the ventilation, the end cell dividers 180 are "low cut" to define a plenum adjacent each of the vents 162. The end cell dividers 180 are in particular formed with a saddle shape having a v-shaped portion 185 defining angles $\beta$ and $\gamma$. The angles $\beta$ and $\gamma$ are preferably 20° and 15°, respectively. The v-shaped portion 185 also defines an apex 187 located a distance "T" from the top edge of the tray 104. The distance "T" is preferably 0.837", which is sufficient to provide cooling of the eggs located at the end of the tray 104 and allow for effective air circulation.

Also, each of the comer cells 135, and the exterior cells 138 adjacent the ends of the tray 104, are formed with a maximum diameter Dm. The maximum diameter Dm is the largest diameter defined by the respective corner cell 135 or exterior cell 138 which is generally parallel to the adjacent end of the tray 104. The maximum diameters Dm's of adjacent cells are collinearly aligned to define a reference axis Rm, shown as a dot in FIG. 3. The end cell dividers 180 are "low cut" at locations between the reference axis Rm and the adjacent end of the tray 104 to allow for ventilation of air entrapped within the carton 100 and the atmosphere.

It should be noted that the channels 160 and the cushions 148 are not formed on each of the side wall portions 139A–D for all of the cells 106. In particular, the exposed wall portions 139A–D of the corner cells 135 and the exterior cells 138 are not formed with the cushions 148 and the channels 160 to maximize strength of the cells 106 and provide protection for packaged eggs. The cushions 148 and the channels 160 may weaken the side wall portions 139A–D. To ensure that the cushions 148 can act properly with respect to the cells where there is no full complement of four cushions 148, the cushions 148 are formed to extend further out where there is no cushion 148 on the opposing wall portion 148. For example, as shown in FIG. 3, the exterior cell 138, at the right, is not provided with one of the cushions 148 on the wall portion 139D. Without the cushion 148 on the wall portion 139D, the diameter defined by the cushion 148 formed on the wall portion 139A and the wall portion 139D is larger than the desired diameter G2. Thus, as shown in dashed lines, the cushion 148 is moved inwardly, with the adjacent cell tab 142 getting wider, to achieve the desired diameter G2.

Figure 7:
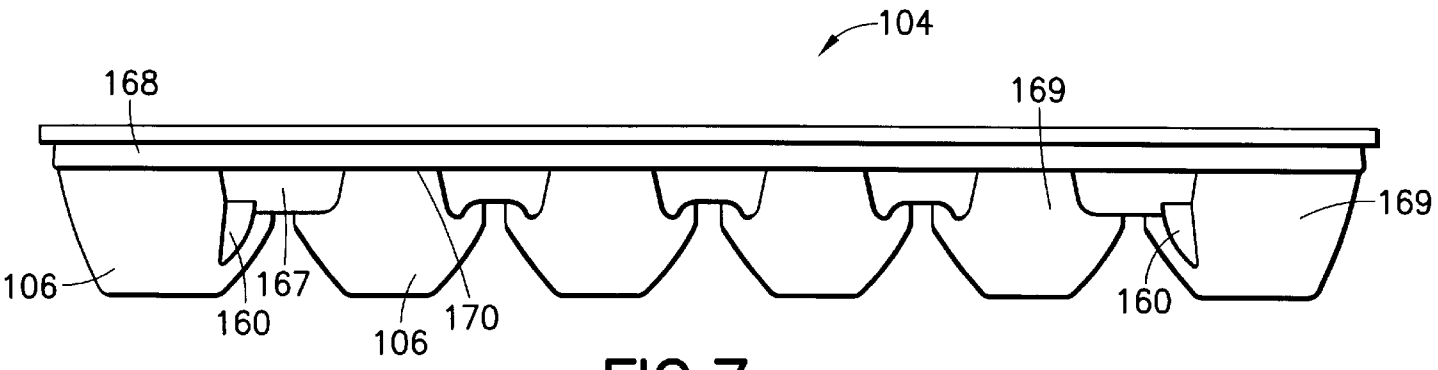
FIG. 7 is a side elevational view of the tray of the egg carton.

Each of the exterior cells 138 has an outwardly extending arcuate portion 169 which generally follows a portion of the contour of the egg receiving surface 140. Referring to FIG. 7, stacking ledges 168 are provided along the longitudinal sides of the tray intermediate the side cell dividers 167 and the top of the tray 104. The stacking ledges 168 each define a free edge 170 which is spaced outwardly from the side cell dividers 167 and other portions of the tray 104, as shown in FIG. 2 by the spacing "x". In stacking the trays 104, the free edges 170 are formed to come into contact with portions of a lower stacked tray 104 and act as a stop to excessive nesting.

The stacking ledges 168 can be continuously formed along each of the longitudinal sides as shown in FIG. 7. Also, the stacking ledges 168 can be wrapped about the corners of the tray 104 to at least partially extend along the ends of the tray 104, as shown in FIG. 6. The stacking ledges 168 can be continuously or discontinuously formed to extend along the ends of the tray 104. Preferably, the stacking ledge 168 continuously extends about the entire tray 104. Where the stacking ledge 168 crosses over the arcuate portions 169, it is preferred that the free edge 170 be spaced from the arcuate portions 169. It should also be noted that the stacking ledge 168 generally coincides with the girths of packaged eggs. As such, the stacking ledge 168 provides additional strength to the tray 104 and additional protection to packaged eggs.

Figure 10:
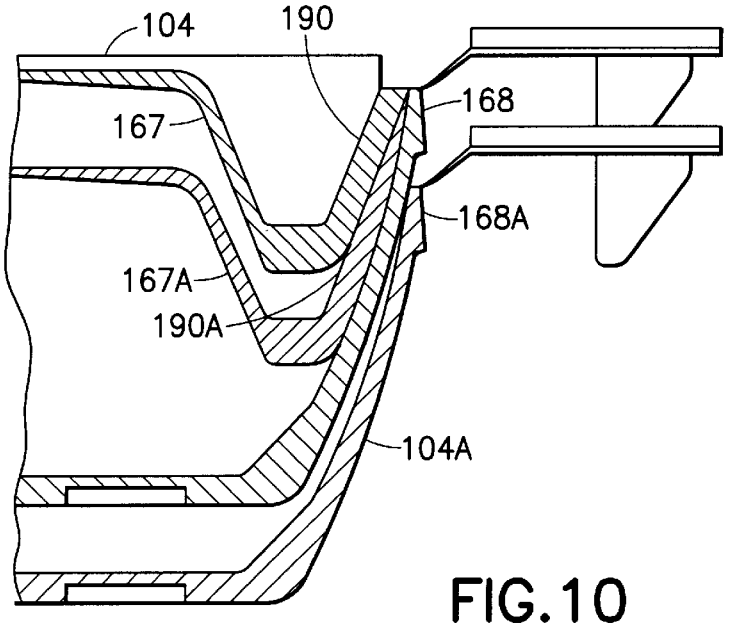
FIG. 10 is a partial cross-sectional view of two nested trays formed in accordance with the subject invention.

With reference to FIG. 2A, the side cell dividers 167 are each formed with a saddle shape and define an angled outer portion 190 at an angle $\epsilon$. The angle $\epsilon$ preferably is 20°. By contouring the side cell dividers 167 with saddle shapes and providing the angled outer portions 190, the trays 104 can be nested with another like tray 104A, wherein like elements are designated with the same reference numeral followed by the character "A". Referring to FIG. 10, the tray 104 is nested in the tray 104A with the side cell dividers 167 and 167A having only the outer portions 190 and 190A in engagement. The engagement of the outer portions 190 and 190A prevents excessive nesting of the trays 104 and 104A. In the preferred embodiment of the invention, the outer portions 190 and 190A act as the principal support structures for the nesting trays 104 and 104A. As shown in FIG. 10, the stacking ledges 168 and 168A are spaced apart along the longitudinal side of the tray 104. The stacking ledges 168 and 168A, however, come into engagement about the corner cells 135, i.e., at locations spaced from the outer portions 190 and 190A, to provide a secondary source of support.

Additionally, any locking system may be used with the egg carton 100. For example, as shown in the Figures, the lid 102 may be formed with locking apertures 172, and the tray 104 may be formed with a locking flap 174 having 176 tabs extending therefrom shaped and located to lockingly engage the locking apertures 172.

As is readily apparent, numerous modifications and changes may readily occur to those skilled in the art. Hence, it is not desired to limit the invention to the exact construction and operation shown and described and, accordingly, all suitable modification equivalents may be resorted to falling within the scope of the invention as claimed.

What is claimed is:

1. A polystyrene egg carton for packaging a plurality of eggs, said egg carton comprising:

a lid; and a tray hingedly connected to said lid, said tray having a plurality of generally cup-shaped cells for accommodating the eggs, each said cell having a tubular side wall having an inner surface, an outer surface, and opposed first and second ends, said first end being open, a planar base extending across said second end, and at least one embossment extending between a location on said base spaced from said side wall and a location on said side wall spaced from said base, wherein said embossment includes an inwardly facing first surface and an outwardly facing second surface, said second surface extending coextensively with said outer surface of said cell to collectively define a continuous, un-indented surface on said cell adjacent said embossment.

2. An egg carton as in claim 1, wherein a plurality of embossments is provided in each cell.

3. An egg carton as in claim 2, wherein, for each said cell, said embossments are circumferentially equally spaced apart about said base.

4. A polystyrene egg carton for packaging a plurality of eggs, said egg carton comprising:

a lid; and a tray hingedly connected to said lid, said tray having a plurality of generally cup-shaped cells for accommodating the eggs, each said cell having a tubular side wall defining opposed first and second ends, said first end being open, a planar base extending across said second end, said base having an interior surface facing said first end and an exterior surface facing away from said first end, said exterior surface defining a generally planar resting surface and a raised portion extending inwardly of said resting surface toward said first end, wherein said first portion of said base is located between said raised portion and said interior surface, said first portion being formed with a first density, and a second portion of said base is located between said resting surface and said interior surface, said second portion being formed with a second density, said first density being greater than said second density.

5. An egg carton as in claim 4, wherein said raised portion is completely encircled by said resting surface.

6. A polystyrene egg carton for packaging a plurality of eggs, said egg carton comprising:

a lid; and a tray hingedly connected to said lid, said tray having a plurality of generally cup-shaped cells for accommodating the eggs, each said cell having a tubular side wall defining opposed first and second ends, said first end being open, a planar base extending across said second end, said side wall having an inwardly facing egg receiving surface defining a first diameter at a first distance from said base, wherein a plurality of inwardly extending cushions protrude from said side wall, each said cushion defining an inner contact point spaced from said egg receiving surface, said inner contact points of said cushions collectively defining a second diameter, said second diameter being also located at said first distance from said base, said second diameter being less than said first diameter, wherein each said cushion is formed with a pleat shape having inner and outer surfaces, said inner contact point being defined by said inner surface, said outer surface extending from said first end of said cell towards said second end of said cell and being tapered to define a downwardly facing open mouth spaced from said first end, said open mouth being formed to nestingly receive a similar shaped cushion.

7. An egg carton as claim 6, wherein said cushions are deflectable.

8. An egg carton as in claim 6, wherein said inwardly facing egg receiving surface defines a third diameter nominally equal to the girth of a first size class of egg, said second diameter nominally equals the girth of a second size class of egg, the first size class of egg being larger than the second size class of egg.

9. An egg carton as in claim 6, wherein said second diameter is defined closer to said base than said third diameter.

10. A polystyrene egg carton for packaging a plurality of eggs, said egg carton comprising:

a lid; and a tray hingedly connected to said lid so that said lid can rotate relative to said tray, said lid being selectively rotatable between an open position with said lid being spaced from said tray and a closed position with said lid abutting said tray, said tray having a plurality of generally cup-shaped cells for accommodating the eggs, each said cell having a tubular side wall defining opposed first and second ends, said first end being open, a planar base extending across said second end, said side wall having an inwardly facing egg receiving surface with at least one channel being recessed thereinto, said channel extending from said first end into proximity with said base, wherein said egg carton defines a vent to communicate air entrapped in said carton, with said lid being said closed position, with ambient air.

11. An egg carton as in claim 10, wherein said channel being of sufficient length to extend below a girth of an egg disposed air space down in said cell.

12. A polystyrene egg carton for packaging a plurality of eggs, said egg carton comprising:

a lid; and a tray hingedly connected to said lid, said tray having a plurality of generally cup-shaped cells for accommodating the eggs, said tray having an open top and a generally rectangular shape with two longitudinal sides and two ends, said cells being spaced apart with webs extending between adjacent said cells, said cells located along each said longitudinal side of said tray defining outwardly extending arcuate portions, said webs located along said longitudinal sides being recessed inwardly of said arcuate portions, wherein a stacking ledge corresponds to each of said webs located along said longitudinal sides, each said stacking ledge being located intermediate respective said web and said open top of said tray, and each said stacking ledge extends outwardly from said tray to define a free edge spaced outwardly from respective said web.

13. An egg carton as in claim 12, wherein said stacking ledges are joined along each said longitudinal side to extend the full length thereof.

14. An egg carton as in claim 13, wherein said stacking ledges are continuously joined to extend about the entire said tray.

15. A polystyrene egg carton for accommodating a plurality of eggs, said egg carton comprising:

a tray having a plurality of cup-shaped cells for accommodating the eggs; and a lid hingedly connected to said tray, said lid having a planar top portion and an upstanding side wall extending about said top portion, said side wall having an inwardly facing inner surface and an outwardly facing outer surface, said side wall being formed with at least one straight portion and at least one corner, said straight portion being cross-sectionally formed with a first thickness as measured between said inner and outer surfaces, said corner being cross-sectionally formed with a second thickness as measured between said inner and outer surfaces, said second thickness being greater than said first thickness.

16. An egg carton as in claim 15, wherein the portion of said outer surface extending along said corner defines a first radius, the portion of said inner surface extending along said corner defines a second radius, said second radius being different than said first radius.

17. An egg carton as in claim 16, wherein said second radius is greater than said first radius.

18. A polystyrene egg carton for packaging a plurality of eggs, said egg carton comprising:

a tray having a plurality of generally cup-shaped cells for accommodating the eggs; and a lid hingedly connected to said tray, said lid having a planar top portion and an upstanding side wall extending therefrom, said lid also having a post extending from top portion, said post being bounded by said side wall, said post having a support surface spaced from said top portion and a post side wall extending continuously between said support surface and said top portion, said post side wall having an indentation being formed therein.

19. An egg carton as in claim 18, wherein said indentation extends from said top portion toward said support surface.

20. An egg carton as in claim 1, wherein said inner surface of said cushion is tapered to define an acute angle of 10 degrees relative to a vertical axis.

21. A polystyrene egg carton for packaging a plurality of eggs, said egg carton comprising:

a lid; and a tray hingedly connected to said lid, said tray having spaced-apart first and second ends, and a plurality of generally cup-shaped cells for accommodating the eggs, wherein said plurality of cells includes first and second cells located adjacent to said first end, both said first cell and said second cell each having a tubular side wall defining opposed first and second cell ends, said first cell end being open, a planar base extending across said second cell end, said side wall being arcuately formed about an axis disposed perpendicular to said base with various diameters being defined by said side wall between said first and second cell ends, said various diameters including a maximum diameter, said maximum diameter being the largest of said various diameters which is generally parallel to said first end, wherein said maximum diameter of said first cell and said maximum diameter of said second cell being aligned generally collinearly to define a reference axis, and wherein said first and second cells being joined by a cell divider, said cell divider being low cut at locations between said reference axis and said first end to define a plenum adjacent said first end.

22. An egg carton as in claim 21, wherein said lid is formed to cooperatively define a vent with a portion of said first end of said tray.

23. An egg carton as in claim 22, wherein said vent is located adjacent to said plenum.

24. An egg carton as in claim 21, wherein said cell divider generally defines a V-shape having a first wall extending angularly generally towards said first end, and a second wall extending angularly generally away from said first end.

25. An egg carton as in claim 24, wherein said first wall defines an acute angle of 20 degrees relative to a vertical axis.

26. An egg carton as in claim 24, wherein said second wall defines an acute angle of 15 degrees relative to a vertical axis.

27. An egg carton as in claim 24, wherein said tray further has a top edge extending thereabout, and wherein said cell divider defines an apex at the junction of said first and second walls, said apex being located a distance of 0.837 inches from said top edge as measured along a vertical axis.

28. A combination comprising:

first and second polystyrene egg cartons, each for packaging a plurality of eggs, each said egg carton including:

a lid; and a tray hingedly connected to said lid, said tray having spaced-apart first and second longitudinal sides, and a plurality of generally cup-shaped cells for accommodating the eggs, wherein said plurality of cells includes first and second cells located adjacent to said first longitudinal side, said first and second cells being joined by a cell divider, said cell divider being formed to define a generally V-shape with a first wall extending angularly generally towards said first longitudinal side, and a second wall extending angularly generally away from said first longitudinal side;

wherein, said first and second egg cartons are disposed in a stacked arrangement with the cells of said first egg carton being nestingly received in said cells of said second egg carton, and with said first wall of said cell divider of said first egg carton being in bearing engagement with said first wall of said cell divider of said second egg carton, said bearing engagement limiting the depth of nesting of said first egg carton into said second egg carton, whereby excessive nesting is avoided.

29. A combination as in claim 28, wherein each said tray defines a plurality of corners, and, wherein, in said stacked arrangement, said corners of said first egg carton are in bearing engagement with said corners of said second egg carton.

30. A polystyrene egg carton for packaging a plurality of eggs, said egg carton comprising:

a lid; and a tray hingedly connected to said lid, said tray having a plurality of generally cup-shaped cells for accommodating the eggs, each said cell having a tubular side wall defining an inner surface, an outer surface, and opposed first and second ends, said first end being open, a planar base extending across said second end, said base having an interior surface facing said first end and an exterior surface facing away from said first end, said interior surface extending from said inner surface, said exterior surface defining a generally planar resting surface and a raised portion extending inwardly of said resting surface toward said first end, wherein said outer surface of said cell extends to said resting surface.

* * * * *